US008342506B2

(12) United States Patent
Katayama

(10) Patent No.: US 8,342,506 B2
(45) Date of Patent: Jan. 1, 2013

(54) SHEET CONVEYANCE APPARATUS, IMAGE FORMING APPARATUS, AND IMAGE READING APPARATUS

(75) Inventor: Hiromasa Katayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/952,500

(22) Filed: Nov. 23, 2010

(65) Prior Publication Data

US 2011/0127709 A1 Jun. 2, 2011

(30) Foreign Application Priority Data

Nov. 30, 2009 (JP) ..... 2009-272571

(51) Int. Cl.
*B65H 3/44* (2006.01)

(52) U.S. Cl. ..... 271/9.13; 271/272

(58) Field of Classification Search ..... 271/9.11, 271/9.13, 10.11, 225, 272
See application file for complete search history.

(56) References Cited

U.S. PATENT DOCUMENTS

| | | | | |
|---|---|---|---|---|
| 6,161,829 | A * | 12/2000 | Kusumi | 271/9.05 |
| 7,621,519 | B2 | 11/2009 | Sagawa | |
| 7,681,874 | B2 * | 3/2010 | Kusumi | 271/6 |
| 2005/0062222 | A1 * | 3/2005 | Willis | 271/272 |
| 2008/0296837 | A1 * | 12/2008 | Jowett et al. | 271/264 |

FOREIGN PATENT DOCUMENTS

JP 2008-037587 A 2/2008

* cited by examiner

*Primary Examiner* — Jeremy R Severson
(74) *Attorney, Agent, or Firm* — Canon USA Inc IP Division

(57) ABSTRACT

In a sheet conveyance apparatus, a sponge roller is provided at a joining portion in which a first sheet conveyance path joins a second sheet conveyance path. A leading edge of a sheet or tailing edge of a sheet abuts at the sponge roller when the sheet is conveyed from the first conveyance path to the second conveyance path. In a projection surface in a direction orthogonal to a sheet conveyance direction in the second sheet conveyance path, an outer periphery of the sponge roller and an outer periphery of a conveyance roller, which is positioned in a downstream side, are partially overlapped in the second conveyance path. Further the sponge roller is rotatably arranged. With such a configuration, the noise generated in the joining portion can be reduced, and effect to reduce the noise can be continued.

12 Claims, 16 Drawing Sheets

(PRIOR ART)

SHEET CONVEYANCE APPARATUS, IMAGE FORMING APPARATUS, AND IMAGE READING APPARATUS

BACKGROUND OF THE INVENTION

1. Field of the Invention

The present invention relates to a sheet conveyance apparatus for conveying sheets such as recording paper or documents, an image forming apparatus, and an image reading apparatus including the sheet conveyance apparatus.

2. Description of the Related Art

Recently, an operation noise of a copying machine has been reduced by various noise countermeasures. As a result, a noise, which has been submerged before by an operation noise generated by an image forming unit in a copying machine, more specifically, a noise generated by abutting a sheet to a conveyance guide during sheet conveyance can be heard.

As such a noise, there is a noise generated when a leading edge of a sheet S collides against a conveyance guide 400 at a joining portion where one conveyance path joins with another conveyance path as illustrated in FIG. 13A. Further, as another noise, there is a noise generated when a tailing edge of the sheet S is guided in a curved conveyance path and reaches the joining portion as illustrated in FIG. 13B, because a bent sheet returns to an original state by elasticity of the sheet and hits the conveyance guide 400.

As for a countermeasure to the noise generated when a leading edge of a sheet collides against a conveyance guide at the joint part or a tailing edge collides against the conveyance guide at a time of having passed through the conveyance path, Japanese Patent Application Laid-Open No. 2008-37587 discusses a technique for providing a conveyance belt rotating in a conveyance direction at the joining portion.

However, in the conventional apparatus using the conveyance belt at the joining portion, since the conveyance belt has a function to convey the sheet in addition to a function to soften the collision, it is desired to use a high friction material having high hardness (e.g., about 60° Hs in Japan Industrial Standard A (JIS A) for the conveyance belt. If a material having low hardness is used as a material for the conveyance belt, the conveyance belt is crushed at a nip portion between the conveyance belt and a conveyance roller, so that a sheet that is being conveyed is damaged, e.g., deformation of a sheet or bending of a leading edge occurs.

However, the hardness of the conveyance belt needs to be set low for effectively reducing the noise at a time of the sheet collision. Therefore, in the apparatus using the conveyance belt at the joining portion, it has been difficult to satisfy both sheet conveyance performance and reduction of the noise generated by the sheet collision.

SUMMARY OF THE INVENTION

The present invention is directed to a sheet conveyance apparatus, and an image forming apparatus, and an image reading apparatus including the sheet conveyance apparatus, capable of reducing a noise generated at a joining portion of two sheet conveyance paths having different conveyance directions.

According to an aspect of the present invention, a sheet conveyance apparatus includes a joining portion, a first sheet conveyance unit, a second sheet conveyance unit, and a rotatable elastic roller. The joining portion is configured to join a first sheet conveyance path and a second sheet conveyance path. The first sheet conveyance unit is provided on the upstream side of the joining portion and configured to convey a sheet in the first sheet conveyance path. The second sheet conveyance unit is provided on the downstream side of the joining portion and configured to convey a sheet conveyed from the first sheet conveyance path and a sheet conveyed to the second sheet conveyance path. The rotatable elastic roller is arranged, in conveyance guide surfaces forming the second sheet conveyance path, along a conveyance guide surface on the side crossing an extension line of the first sheet conveyance path and at a position in which a leading edge of a sheet conveyed from the first sheet conveyance path contacts. A surface part of the elastic roller is configured with an elastic material having lower hardness than hardness of a surface part of the second sheet conveyance unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
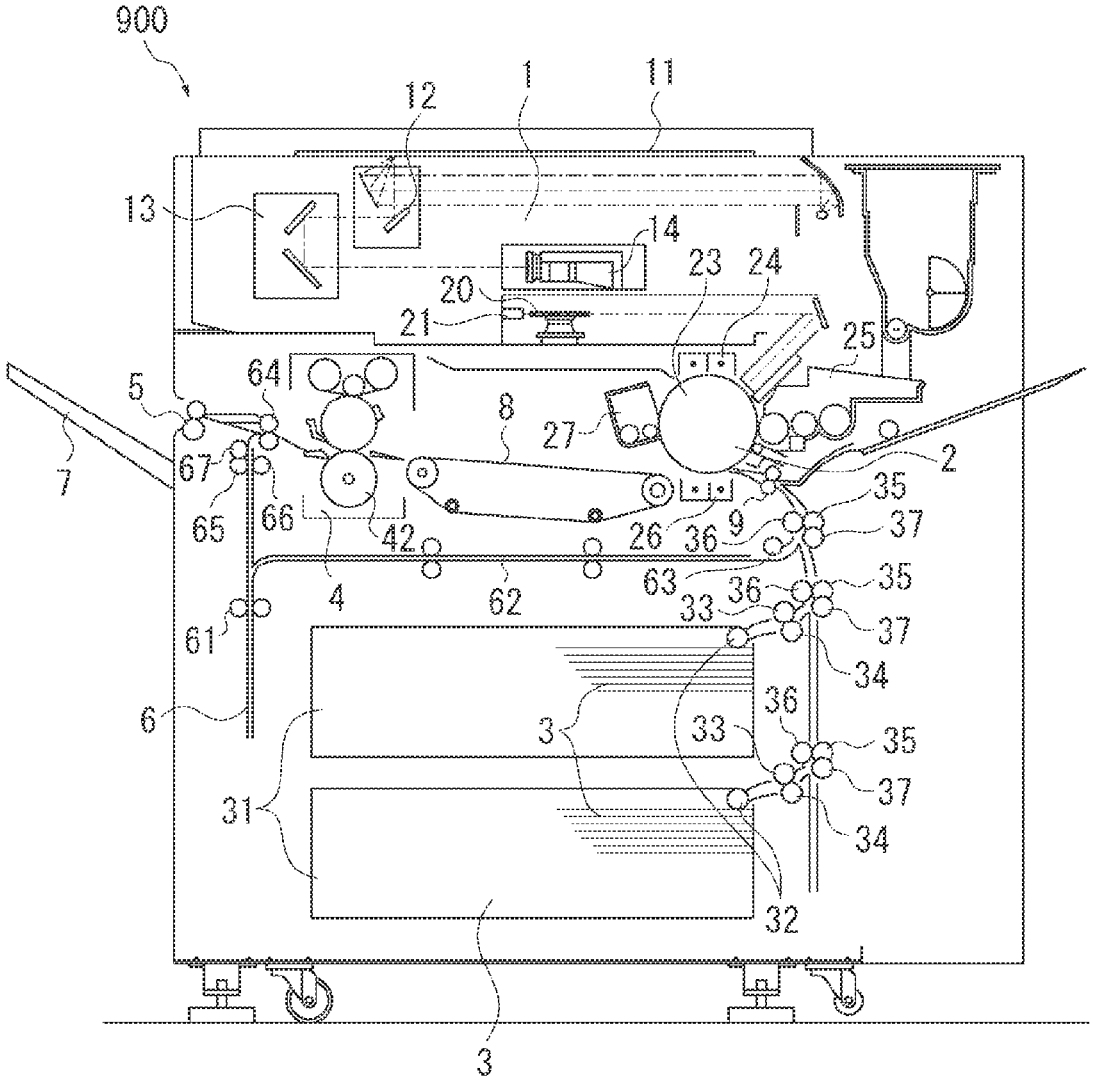
FIG. 1 is a cross-sectional view illustrating an image forming apparatus including a sheet conveyance apparatus according to an exemplary embodiment of the present invention.

FIG. 1 illustrates a cross section of an image forming apparatus 900 including a sheet conveyance apparatus according to an exemplary embodiment of the present invention.

The image forming apparatus 900 illustrated in FIG. 1 includes a reader unit 1 for reading a document, and an image forming unit 2 for forming an image (a toner image) based on the read document. The image forming apparatus 900 further includes a feeding unit 3 for feeding a sheet to the image forming unit 2, a fixing unit 4 for fixing the toner image formed on a sheet in the image forming unit 2, a external-discharge roller pair 5 for discharging the fixed sheet, and a reversing unit 6 for reversing the front side and the back side of the fixed sheet. Each unit of the image forming apparatus 900 will be described in order from the reader unit 1.

<Reader Unit 1>

A document laid on a document positioning glass plate 11 is irradiated by a scanning optical system 12 having a light source and a reflection mirror group, and the reflected light is image-formed on a charge coupled device (CCD) sensor 14 (hereinafter, referred to as CCD 14) through a reducing lens 13, photoelectric-converted, and analog/digital (A/D)-converted.

<Image Forming Unit 2>

Based on image information read by the reader unit 1, a laser light-emitting unit 21 causes a laser light to scan on a photosensitive drum 23 by rotating a polygonal mirror 20, and forms a latent image on the photosensitive drum 23 previously charged by a charging device 24. A developing unit 25 develops the latent image, and forms a toner image on the photosensitive drum 23. A transfer charging device 26 transfers the toner image formed on the photosensitive drum 23 to a sheet S. After the toner image is transferred, a cleaning unit 27 removes a toner remained on the drum surface.

<Sheet Feeding Unit 3>

<Sheet Feeding Unit 3>

A sheet feeding cassette 31 stacking and storing the sheet S is detachably mounted on a lower part of the image forming apparatus 900. The sheet S fed by a pickup roller 32 is separated by a conveyance roller 33 and a retard roller 34, and conveyed. Then, the sheet S is skew-corrected in a registration unit 9 and conveyed to the image forming unit 2.

<Fixing Unit 4>

The sheet S to which the toner image is transferred in the image forming unit 2 is conveyed to the fixing unit 4 by a conveyance belt 8. The fixing unit 4 is configured with a roller pair 42 including a heating roller and a pressure roller. The heating roller internally has a halogen heater (not illustrated). The pressure roller is pressed to the heating roller at a predetermined pressure by a spring (not illustrated). The sheet S carrying an unfixed toner is applied with heat and pressure, by passing through a nip portion of the roller pair 42 including the heating roller and the pressure roller, so that the toner image is fused and fixed.

In a one-sided copying mode, the fixed sheet S is discharged outside an apparatus body by a external-discharge roller pair 5, and is stacked on a discharge tray 7.

<Reversing Unit 6>

In a two-sided copying mode, after passing through the fixing unit 4, the sheet S is conveyed to the reversing unit 6 by a switchback roller pair 61. The sheet S is conveyed to a two-side conveyance path 62 by the reverse rotation of the switchback roller pair 61, conveyed to the registration unit 9 by a sheet re-feeding roller 63 for forming an image again, and is discharged outside the apparatus body via similar processes to the one-sided copying mode.

<Configuration of Conveyance Unit>

Figure 2:
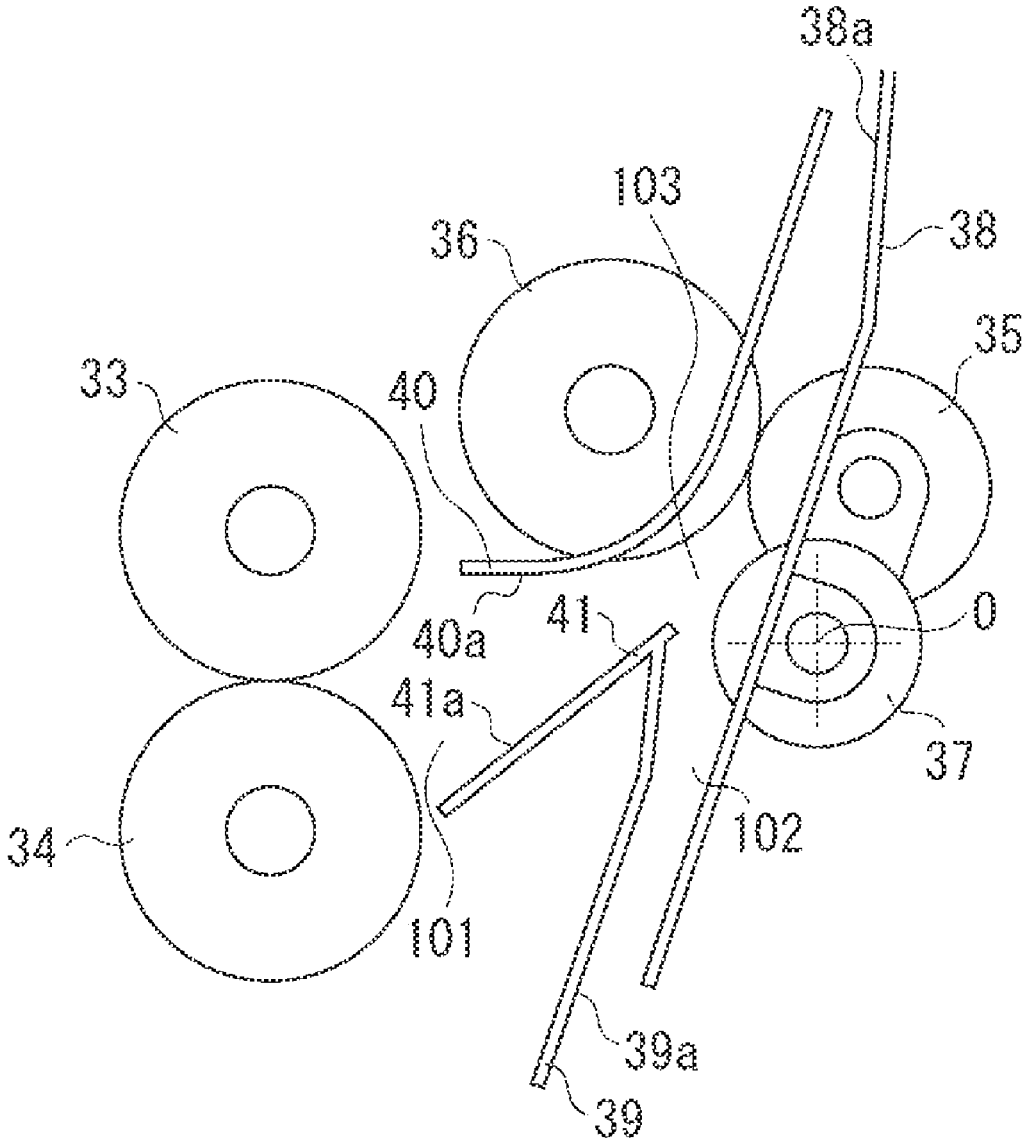
FIG. 2 is a cross-sectional view illustrating a configuration according to an exemplary embodiment.

A sheet conveyance apparatus to which the present invention is applied will be described below with reference to FIG. 2. The present exemplary embodiment includes a first sheet conveyance path 101 for guiding the sheet S, which is fed from the sheet feeding cassette 31 and is separated by the conveyance roller 33 and the retard roller 34, and a second sheet conveyance path 102 for guiding the sheet S conveyed from a lower direction to an upper direction. Further, a joining portion 103 at which the first sheet conveyance path 101 and the second sheet conveyance path 102 are joined is configured. In addition, the first sheet conveyance unit of the present exemplary embodiment is configured with the conveyance roller 33 and the retard roller 34.

The sheet S conveyed from the first sheet conveyance path 101 passes through the joining portion 103 and is guided to the second sheet conveyance path 102. The joining portion 103 is formed by being surrounded with a conveyance guide surface 38*a* of the conveyance guide 38, a conveyance guide surface 39*a* of the conveyance guide 39, a conveyance guide surface 40*a* of the conveyance guide 40, and a conveyance guide surface 41*a* of the conveyance guide 41.

In addition, the conveyance guide surface 38*a* is a conveyance guide surface forming the second sheet conveyance path 102, and positioned so as to cross the first sheet conveyance path 101 when the first conveyance path 101 is extended.

The conveyance guide surface 39*a* forms an upstream of the second sheet conveyance path 102 relative to the joining portion 103. The conveyance guide surface 40*a* forms a downstream of the first sheet conveyance path 101, and forms a downstream of the second sheet conveyance path 102 relative to the joining portion 103. The conveyance guide surface 41*a* forms a downstream of the first sheet conveyance path 101.

Further, the conveyance guide surface 39*a* and the conveyance guide surface 41*a* form a part of the joining portion 103, and are positioned on an upstream of the conveyance guide surface 40*a* in the sheet conveyance direction of the sheet S which is conveyed to the second sheet conveyance path 102.

A conveyance roller 36 and a conveyance roller 35 configuring the second sheet conveyance unit are provided on the downstream side of the conveyance direction with respect to the joining portion 103. The conveyance roller 36 and the conveyance roller 35 convey the sheet S conveyed from the first sheet conveyance path 101 and the sheet S conveyed to the second sheet conveyance path 102. In addition, the conveyance roller 36 is rotated by inputting driving force from a driving unit (not illustrated). The conveyance roller 35 is provided to press and contact the conveyance roller 36, and passively rotated by the conveyance roller 36 or a sheet conveyed to between the conveyance roller 36 and the conveyance roller 35.

On the second sheet conveyance path 102, a sponge roller 37 (an elastic roller), which is an elastic body, is rotatably arranged on the upstream sides in the sheet conveyance directions of the conveyance roller 36 and the conveyance roller 35. A leading edge of the sheet S conveyed from the first sheet conveyance path 101 abuts the sponge roller 37.

A rotation axis line which is a rotation center O of the sponge roller 37 is positioned so as to be orthogonal to the sheet conveyance direction in the second sheet conveyance path 102. Further, the rotation axis line is positioned to nip the conveyance guide surface 38*a* with the second sheet conveyance path 102.

A material of sponge of the sponge roller 37 is polyether-based urethane and has hardness of about 65° of Askar F. A material of the conveyance roller 36 is silicon and has hardness of 60° Hs JIS A. A material of the conveyance roller 35 is a synthetic resin such as a polyacetal resin (POM), and has higher hardness than the sponge material of the sponge roller 37.

Figure 3:
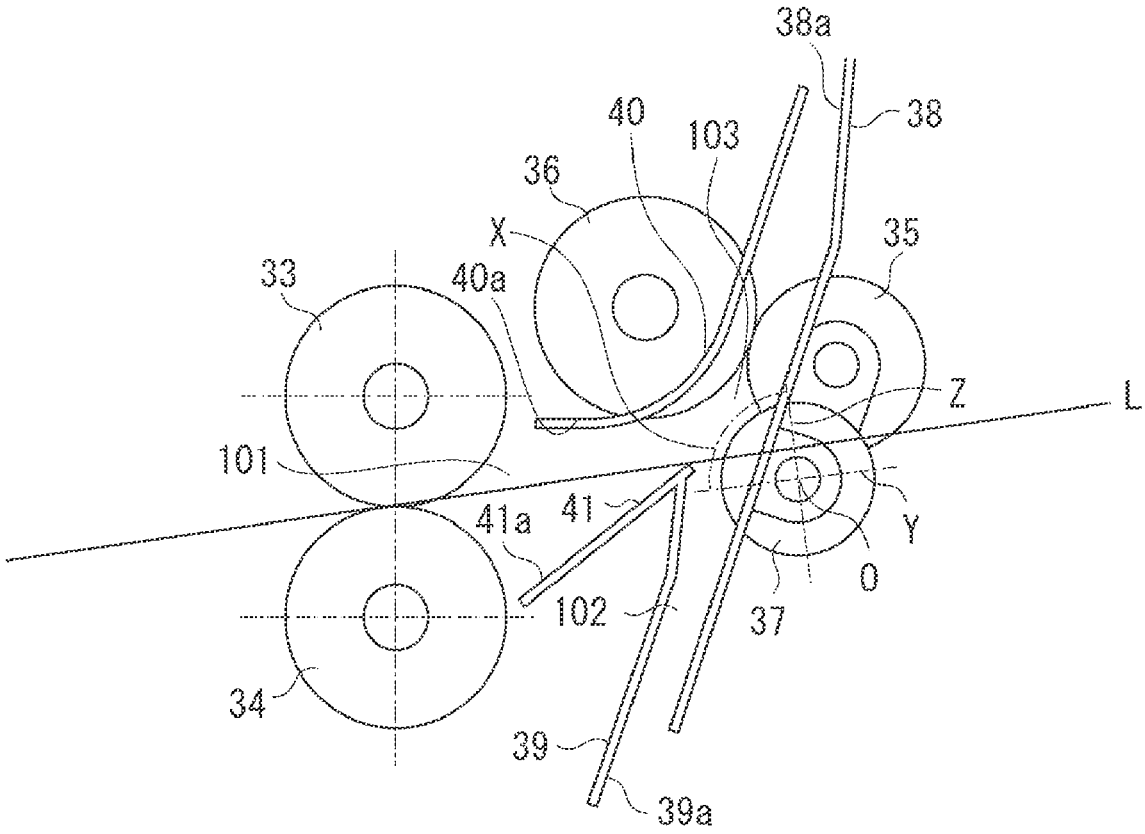
FIG. 3 is a cross-sectional view illustrating an arrangement of a sponge roller according to an exemplary embodiment.

As illustrated in FIG. 3, the rotation center O of the sponge roller 37 is positioned more on the upstream side in the sheet conveyance direction in the second sheet conveyance path 102 than a line L, which passes through the nip point of the conveyance roller 33 and the retard roller 34, and contacts the conveyance guide face 41*a*. In other words, the sponge roller 37 is arranged so that the leading edge of the sheet S conveyed from the first sheet conveyance path 101 contacts an upper left part of the sponge roller 37 (the X part which is an area drawn by a dashed line in FIG. 3).

In FIG. 3, a line Y is parallel to a contact line L and passes through the rotation center O. A line Z is vertical to the contact line L and passes through the rotation center O. The X part is, in a quartered area of the sponge roller 37 by the line Y and the line Z, an area rotating so that the sponge roller 37 guides a leading edge of the sheet S in a direction to a nip portion of the conveyance roller 35 and the conveyance roller 36, by contacting the leading edge of the sheet S.

Figure 4:
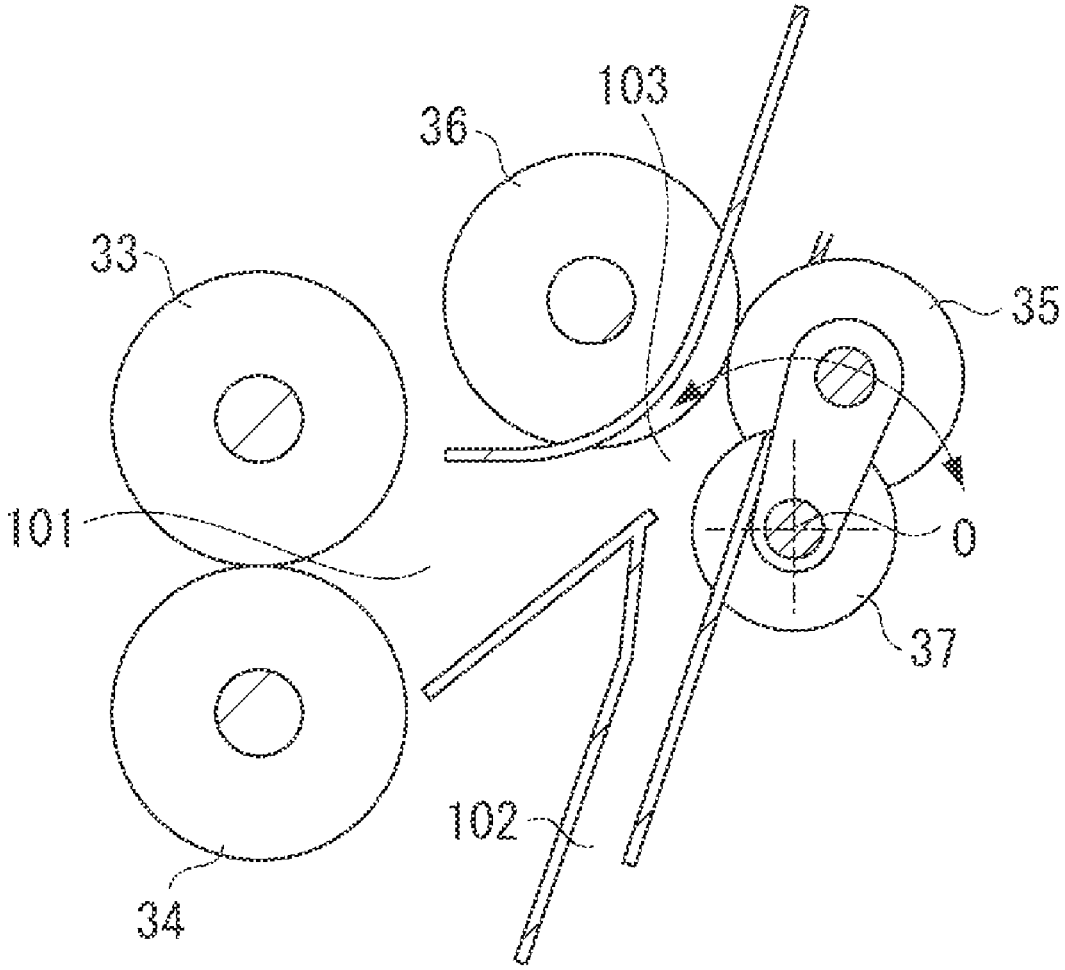
FIG. 4 is a cross-sectional view illustrating a supporting method of a conveyance roller.

As illustrated in FIG. 4, the conveyance roller 35 is supported to rotate around the center O of the sponge roller 37 as a rotation center, and is pressed in the direction of the conveyance roller 36 by a spring (not illustrated). With the configuration, the conveyance roller 36 and the conveyance roller 35 can convey the sheet S, by nipping the sheet S.

Figure 5A:
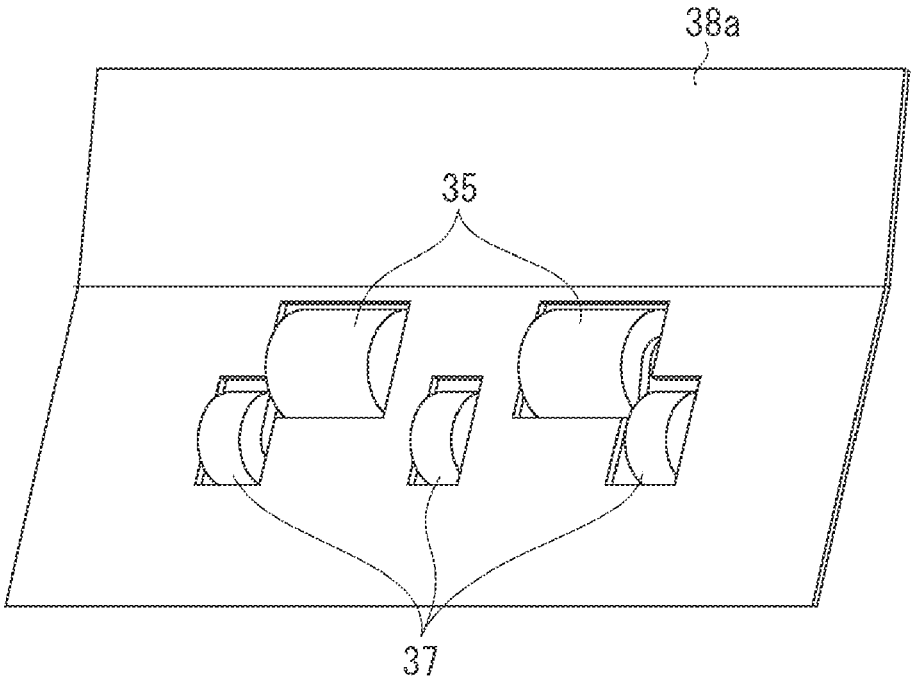
FIGS. 5A and 5B are perspective views illustrating arrangements of a sponge roller and a conveyance roller.
Figure 5B:
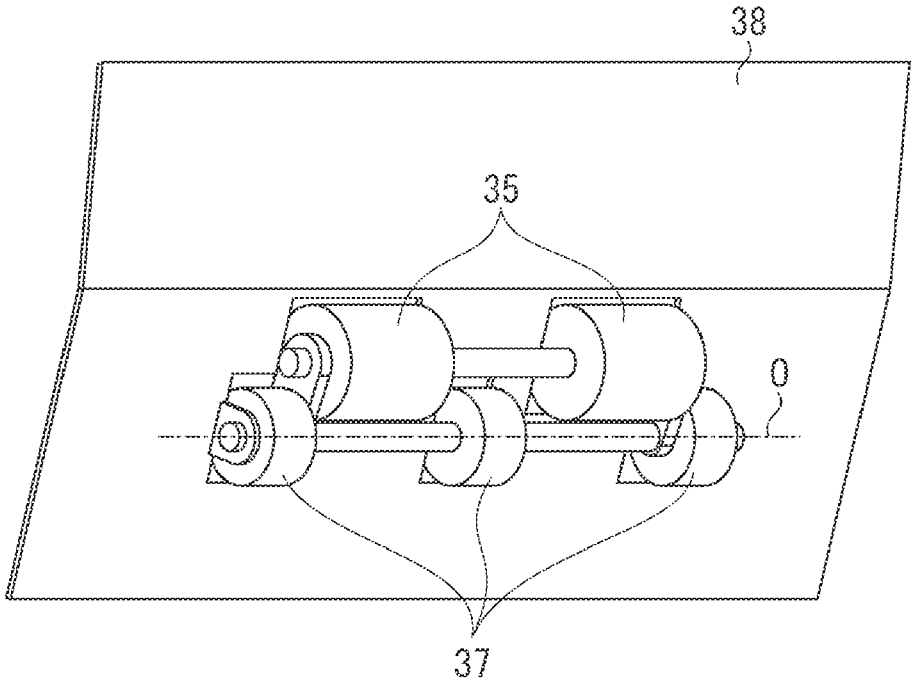

As illustrated in FIG. 5, the sponge roller 37 is alternately arranged with the conveyance roller 35 in the direction orthogonal to the sheet conveyance direction in the second sheet conveyance path 102. More specifically, in a projection surface in the direction orthogonal to the sheet conveyance direction in the second sheet conveyance path 102 (refer to FIG. 2), an outer periphery of the sponge roller 37 and an outer periphery of the conveyance roller 35 are arranged partially overlapping each other on the second sheet conveyance path 102. In addition, the aforementioned projection surface is a virtual plane having, as a vertical line, a line in a direction orthogonal to the sheet conveyance direction in the second sheet conveyance path 102.

In the present exemplary embodiment, a line, which passes through the nip point of the conveyance roller 33 and the retard roller 34 and contacts the conveyance guide surface 41*a*, is described as the line L. However, since the line L is a line passing through the nip point of the conveyance roller 33 and the retard roller 34 and contacting the conveyance guide surface forming a part of the joining portion 103, the line L can contact the conveyance guide surface 39*a*, depending on a shape of the conveyance guide surface.

Figure 6A:
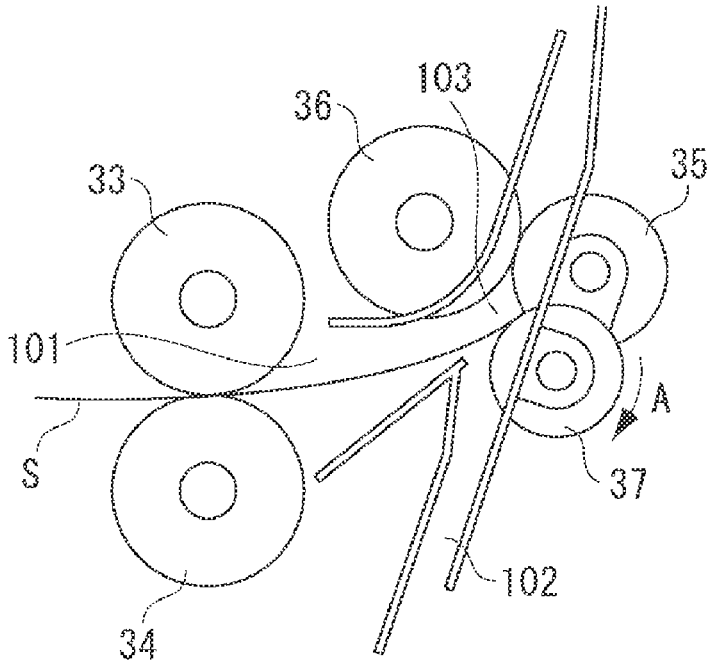
FIGS. 6A, 6B, and 6C are cross-sectional view illustrating movement of a sheet.

Then, an action of the present exemplary embodiment will be described with reference to FIG. 6A to 6C. As illustrated in FIG. 6A, when the sheet S is conveyed from the first sheet conveyance path 101 to the second conveyance path 102 and to the joining portion 103, the leading edge of the sheet S abuts the sponge roller 37. At this time, since an impact by collision of the leading edge of the sheet S can be softened by elasticity of the sponge roller 37, a noise generated at a time of the collision can be reduced. Further, since the sponge roller 37 uses a lower hardness material than the material of the conveyance roller 36 and the material of the conveyance roller 35, the noise generated at a time of the collision can be effectively reduced.

The rotation center O of the sponge roller 37 is positioned more on the upstream side of the sheet conveyance direction in the second sheet conveyance path 102 than the contact line L drawn from the nip point of the conveyance roller 33 and the retard roller 34 to the conveyance guide surface 39*a* (refer to FIG. 3). Therefore, the sponge roller 37 receiving force from the leading edge of the sheet S rotates in a clockwise direction (in the direction of an arrow A). By rotating in such a direction, the leading edge of the sheet S is accurately guided to a nip direction of the conveyance roller 36 and the conveyance roller 35.

Figure 7:
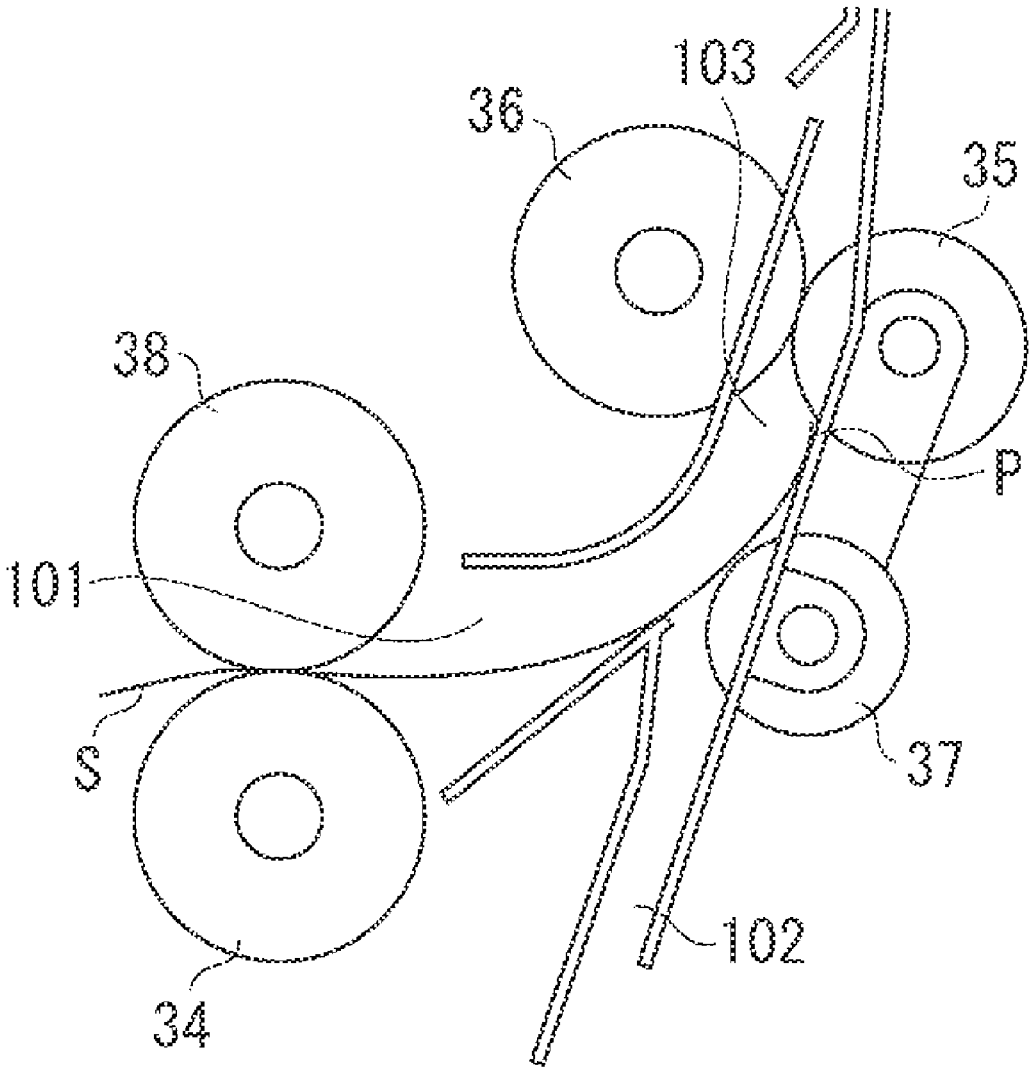
FIG. 7 is a cross-sectional view illustrating a state when a distance between a conveyance roller and a sponge roller is large.

Then, the leading edge of the sheet S abuts the conveyance roller 35. At this time, as illustrated in FIG. 7, if a distance between the sponge roller 37 and the conveyance roller 35 is large, the leading edge of the sheet S may abut a point P on the upstream side of the sheet conveyance direction in the second sheet conveyance path 102, in the points at which the outer periphery of the conveyance roller 35 contacts the conveyance guide surface 38*a*.

The conveyance roller 35 rotates so as to have a predetermined conveyance speed at the nip portion of the conveyance roller 36 and the conveyance roller 35. Therefore, a moving speed of the conveyance roller 35 in the sheet conveyance direction at the point P comes to be slower than the speed at the nip portion.

As a result, when the leading edge of the sheet S abuts the point P in the second sheet conveyance path 102, the conveying speed of the leading edge of the conveyed sheet S is slower than the moving speed at the point P, so that an impact at a time of the collision easily increases and a noise is easily generated by the impact. More specifically, when the leading edge of the sheet S collides with a position closer to the nip portion of the conveyance roller 35, the impact at a time of the collision of the leading edge with the conveyance roller 35 comes to be smaller.

In the first exemplary embodiment, the outer periphery of the sponge roller 37 and the outer periphery of the conveyance roller 35 are arranged partially overlapping each other on the second sheet conveyance path 102 in the projection surface in the direction orthogonal to the sheet conveyance direction. Therefore, the point at which the leading edge of the sheet S abuts the conveyance roller 35 is more on the downstream side of the sheet conveyance direction in the second sheet conveyance path 102 than the point Pin FIG. 7, because the leading edge is guided by the sponge roller 37.

Figure 6B:
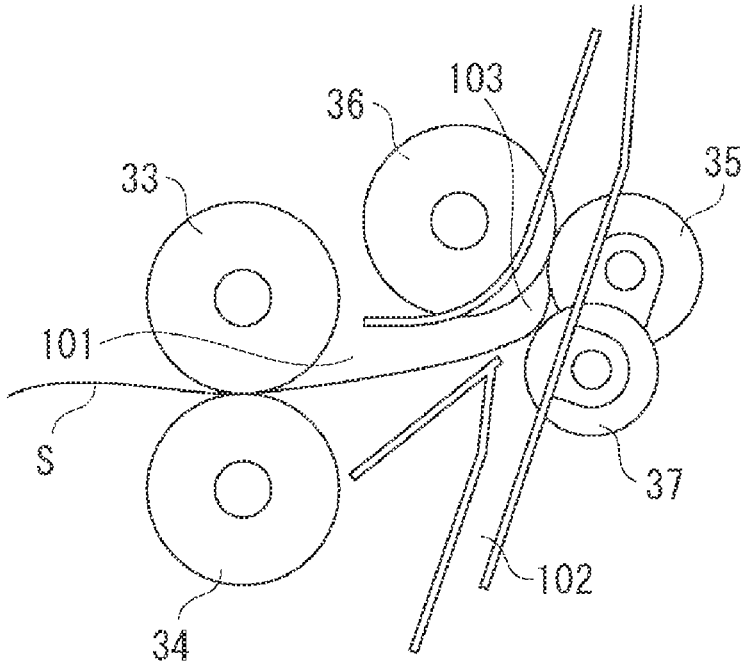

Therefore, since the leading edge of the sheet S collides with a position close to the nip portion as illustrated in FIG. 6B, compared with the case that the leading edge of the sheet S collides with the point P in the second sheet conveyance path 102 as illustrated in FIG. 7, the impact at the time of the collision of the leading edge of the sheet S with the conveyance roller 35 can be softened. As a result, a noise at a time of the collision of the leading edge of the sheet S with the conveyance roller 35 can be reduced.

Figure 6C:
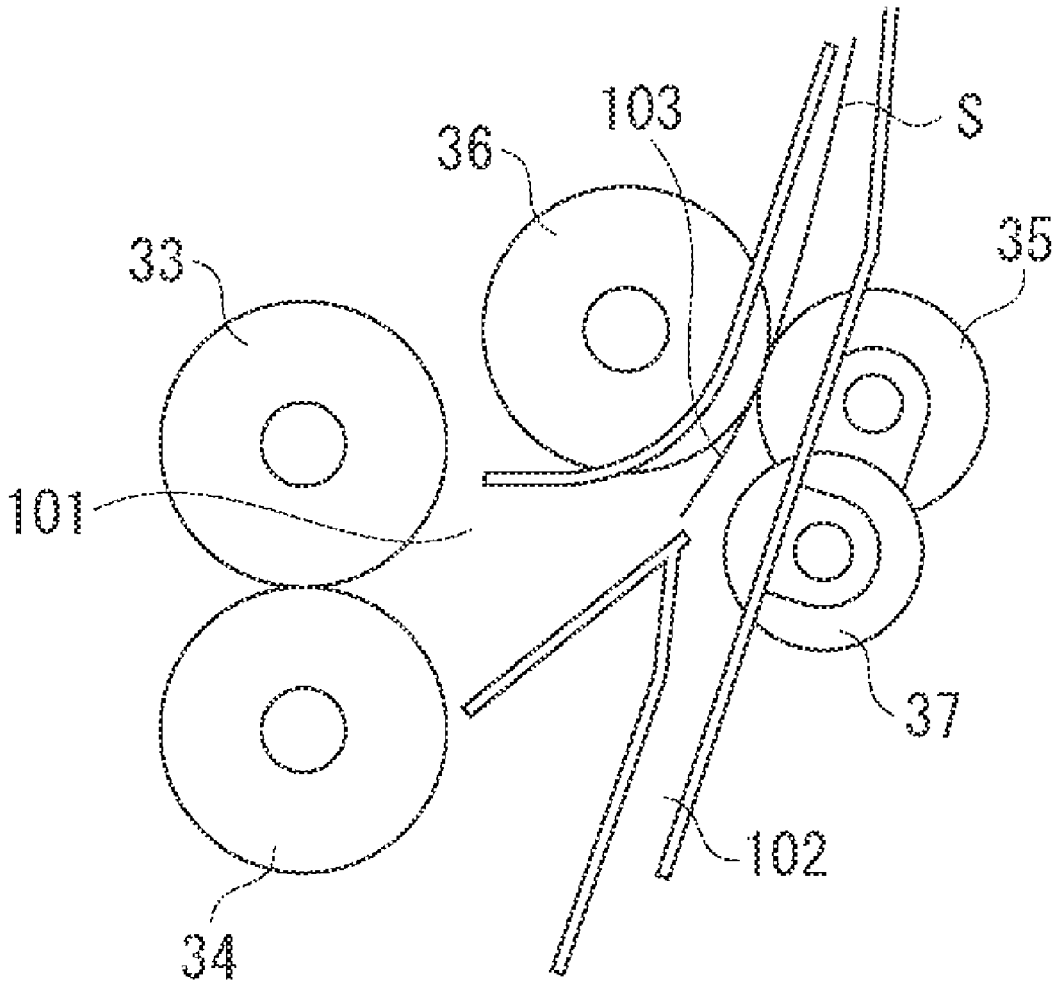

Further, when a trailing edge of the sheet S conveyed by the conveyance roller 36 passes through the first sheet conveyance path 101, as illustrated in FIG. 6C, the trailing edge jumps in a direction to return to an original position by elastic force, and abuts the sponge roller 37. The elastic force of the sponge roller 37 can soften an impact generated by the trailing edge of the sheet S, and can suppress a noise to be generated.

Figure 8:
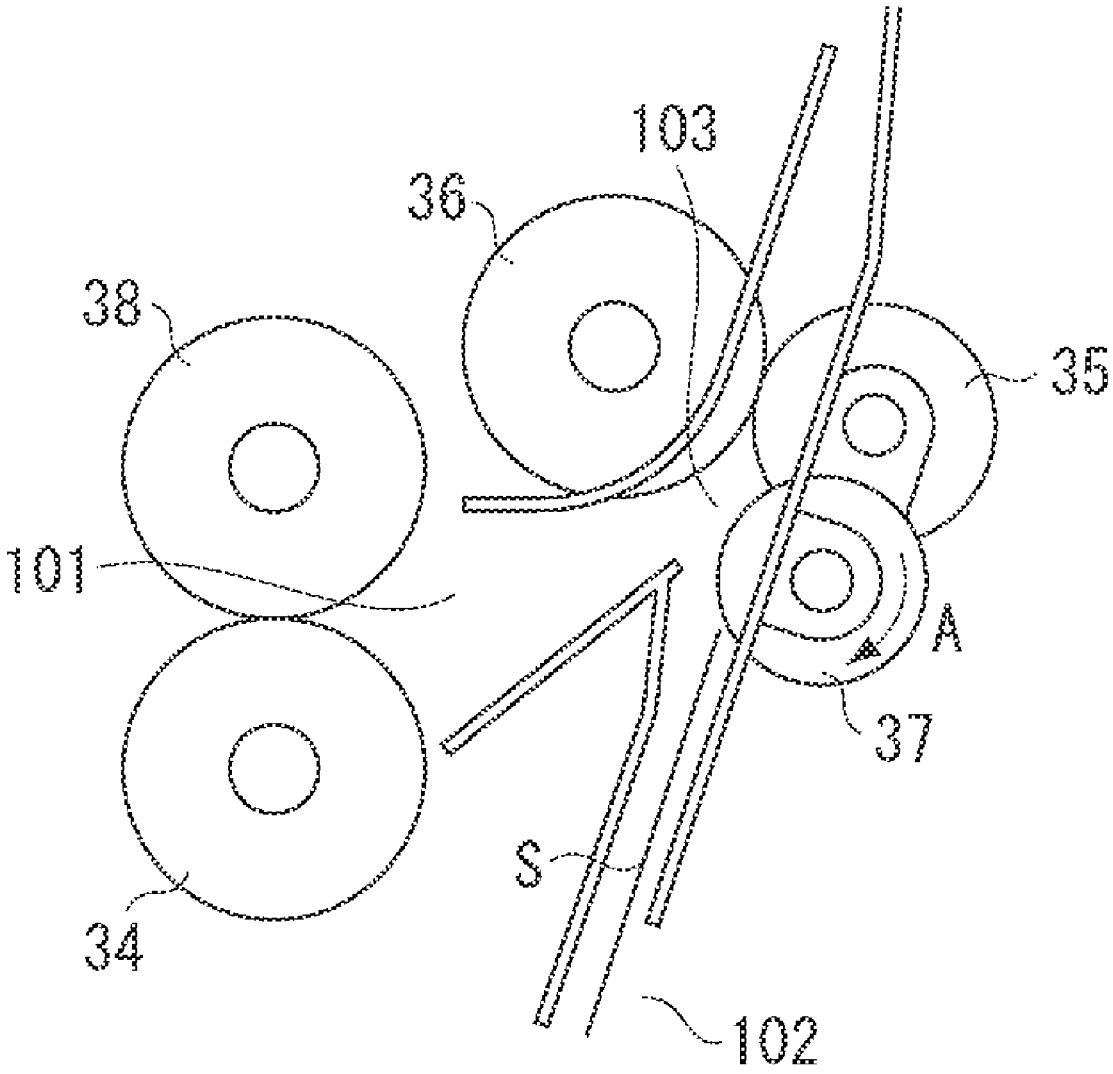
FIG. 8 is a cross-sectional view illustrating a state in which a sheet is conveyed from a second sheet conveyance path.

Further, as illustrated in FIG. 8, the sheet conveyance apparatus according to the present exemplary embodiment can make the leading edge of the sheet S conveyed in the second sheet conveyance path 102 not to collide at the P point on the second sheet conveyance path 102, while absorbing the impact of a collision of the leading edge by the sponge roller 37. As a result, the noise generated at a time of the collision of the leading edge of the sheet S with the conveyance roller 35 can be reduced.

At this time, the sponge roller 37 that has received force from the leading edge of the sheet S rotates in a clockwise direction (in the direction of an arrow A). By rotating in such a direction, the leading edge of the sheet S is accurately guided to the nip direction of the conveyance roller 36 and the conveyance roller 35.

In addition, the materials of the conveyance roller 36 and the conveyance roller 35 have higher hardness than the sponge roller 37. If a material having low hardness, such as the sponge roller 37 used in the present exemplary embodiment, is used for the conveyance roller 36 and the conveyance roller 35 which convey a sheet, the roller collapses, so that such a material is not suitable for conveying the sheet.

A second exemplary embodiment will be described below. FIG. 1 illustrates an image forming apparatus 900 including a sheet conveyance apparatus of the present invention at a reversing unit 6. The reversing unit 6 illustrated in FIG. 1 is positioned on the downstream side of the sheet conveyance direction of a fixing unit 4.

Figure 9:
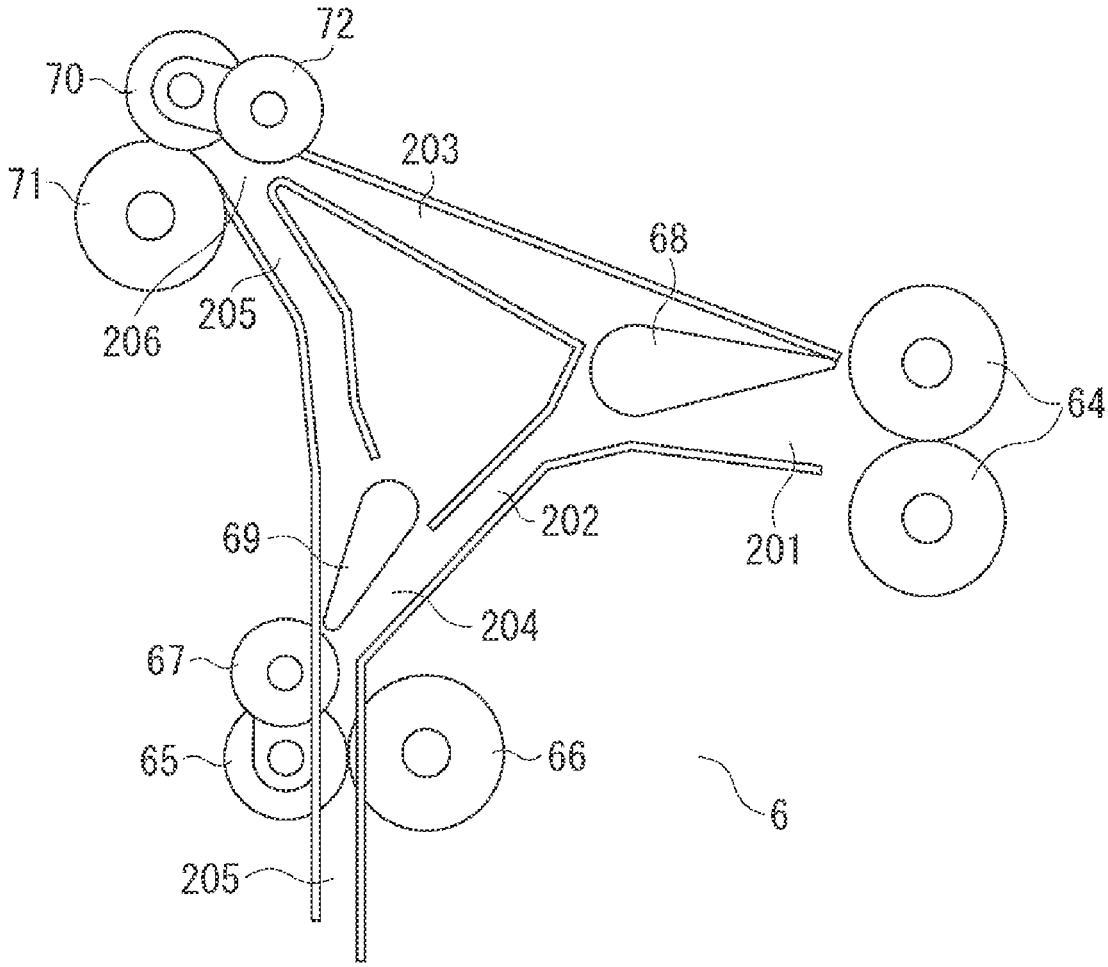
FIG. 9 is a cross-sectional view illustrating a state in which a sponge roller of the exemplary embodiment is arranged at a reversing unit.

The reversing unit 6 is illustrated in detail in FIG. 9. The sheet S on which a toner image is fixed by the fixing unit 4 is conveyed to a post-fixing sheet conveyance path 201 by a pair of sheet discharge rollers 64. In a downstream of the post-fixing sheet conveyance path 201, a first flapper 68 capable of selectively conveying the sheet S to a first reversing sheet conveyance path 202 or a sheet discharge conveyance path 203 is arranged.

A joining portion 204 is formed at a portion where the first reversing sheet conveyance path 202 joins with a second reversing sheet conveyance path 205. The sheet S conveyed from the first reversing sheet conveyance path 202 to the joining portion 204 is conveyed to the second reversing sheet conveyance path 205. In the joining portion 204, a second flapper 69 for discharging a sheet S to the discharge tray 7 is arranged. By the second flapper 69, the sheet S is switched back at the second reversing sheet conveyance path 205 to set an image surface of the sheet S downward.

A process to discharge the sheet S to the discharge tray 7, facing the image surface of the sheet S downward is referred to as a "face down sheet discharge" hereinafter. On the extending line of the first reversing sheet conveyance path 202, a sponge roller 67 is rotatably arranged.

A reversing conveyance roller 65 is supported to rotate about a center of the sponge roller 67 as a rotation center, and is pressed in a direction of a reversing conveyance roller 66 by a spring (not illustrated). Further, the reversing conveyance roller 66 is given driving force from a driving unit (not illustrated). With such a configuration, the reversing conveyance roller 66 and the reversing conveyance roll 65 can convey the sheet S, nipping the sheet S.

Further, the sponge roller 67 is alternately arranged with the reversing conveyance roll 65 in the direction orthogonal to the sheet conveyance direction in the second reversing conveyance path 205. More specifically, in a projection surface in the direction orthogonal to the sheet conveyance direction in the second reversing conveyance path 205, an outer periphery of the sponge roller 67 and an outer periphery of the reversing conveyance roller 65 are arranged, partially overlapping each other on the second reversing conveyance path 205.

As for the sponge roller 67, the first reversing sheet conveyance path 202 corresponds to the first sheet conveyance path of the present invention, and the second reversing sheet conveyance path 205 corresponds to the second sheet conveyance path of the present invention.

A sheet discharge conveyance roller 70 is supported to rotate about the center of the sponge roller 72 as a rotation center, and is pressed in the direction of a sheet discharge conveyance roller 71 by a spring (not illustrated). Further, the sheet discharge conveyance roller 71 is given driving force from a driving unit (not illustrated). With such a configuration, the sheet discharge conveyance roller 71 and the sheet discharge conveyance roller 70 can convey the sheet S, nipping the sheet S.

Further, the sponge roller 72 is alternately arranged with the sheet discharge conveyance roller 70 in the direction orthogonal to the sheet conveyance direction in the sheet discharge conveyance path 203. More specifically, in a projection surface in the direction orthogonal to the sheet conveyance direction in the sheet discharge conveyance path 203, an outer periphery of the sponge roller 72 and an outer periphery of the sheet discharge conveyance roller 70 are arranged, partially overlapping each other on the sheet discharge conveyance path 203.

As for the sponge roller 72, the second reversing sheet conveyance path 205 corresponds to the first sheet conveyance path of the present invention, and the sheet discharge conveyance path 203 corresponds to the second sheet conveyance path of the present invention. Effects of such a configuration are similar to the effects in the positional relationship between the outer periphery of the sponge roller 37 and the outer periphery of the conveyance roller 35 in the first exemplary embodiment.

Then, the movement of the sheet S to be conveyed will be described below with reference to FIGS. 10A to 10F.

Figure 10A:
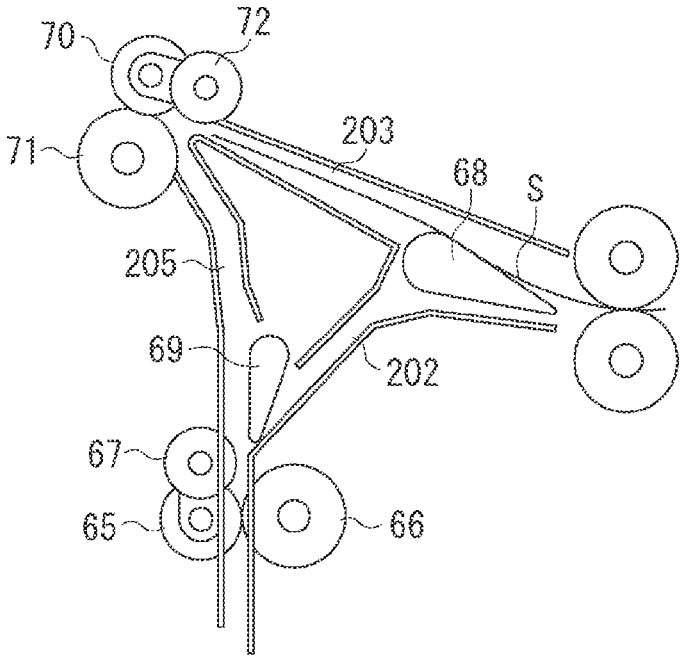
FIGS. 10A to 10F are cross-sectional views illustrating movement of a sheet at a reversing unit.

Other than the case of the facedown sheet discharge and the two-sided printing, the first flapper 68 closes the first reversing sheet conveyance path 202, and the sheet S is conveyed to the sheet discharge tray 7 through the sheet discharge conveyance path 203, as illustrated in FIG. 10A. At this time, since the leading edge of the sheet S abuts the sponge roller 72, an impact by the abutting is absorbed by the elastic force of the sponge roller 72. With such a configuration, the noise generated by the collision of the leading edge of the sheet S with the sheet discharge conveyance roller 70 can be reduced.

Figure 10B:
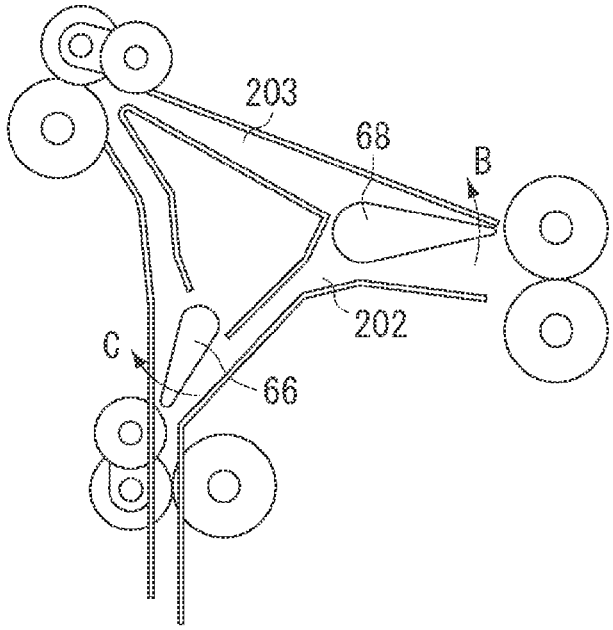
Figure 10C:
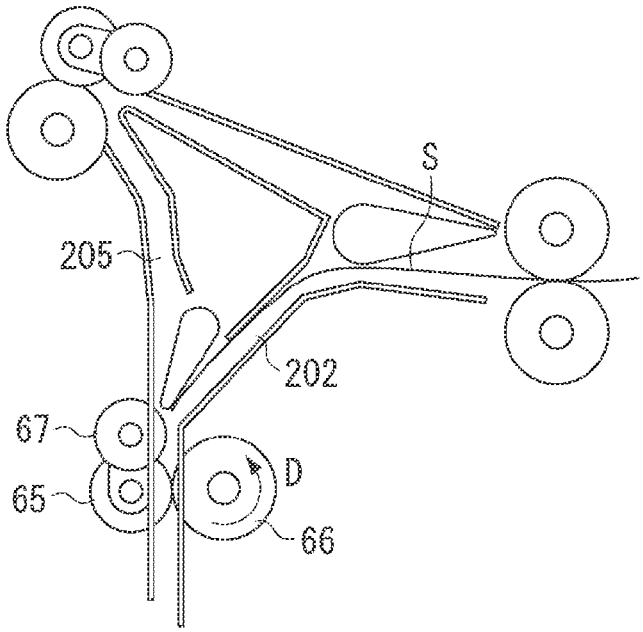

In a case of the facedown sheet discharge or the two-sided printing, the first flapper 68 is rotated in a direction of an arrow B and closes the sheet discharge conveyance path 203, and the second flapper 69 is rotated in a direction of an arrow C, as illustrated in FIG. 10B. Then, as illustrated in FIG. 10C, the sheet S that has been conveyed to the first reversing sheet conveyance path 202 is conveyed to the second reversing sheet conveyance path 205.

At this time, since the leading edge of the sheet S abuts the sponge roller 67, the impact by the contact is absorbed by the elastic force of the sponge roller 67. Thus, the noise generated by the collision can be reduced.

Figure 10D:
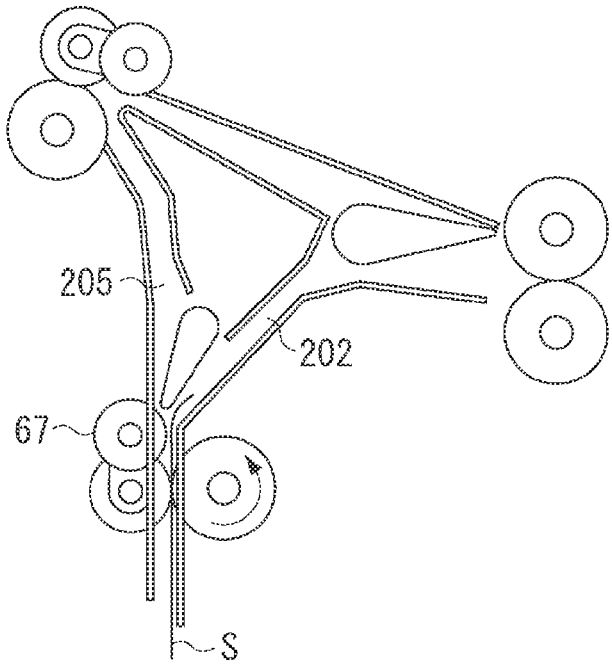

When the sheet is further conveyed, a trailing edge of the sheet S passes through the first reversing sheet conveyance path 202 as illustrated in FIG. 10D. Then, the trailing edge of the sheet S abuts the sponge roller 67 so as to return to a flat state by an elastic force of the sheet S. At this time, an impact by the trailing edge of the sheet S is softened by elasticity of the sponge roller 67 and the noise generated by the collision can be reduced.

After that, the sheet S is conveyed to a two-sided conveyance path 62 in a case of two-sided printing.

Figure 10E:
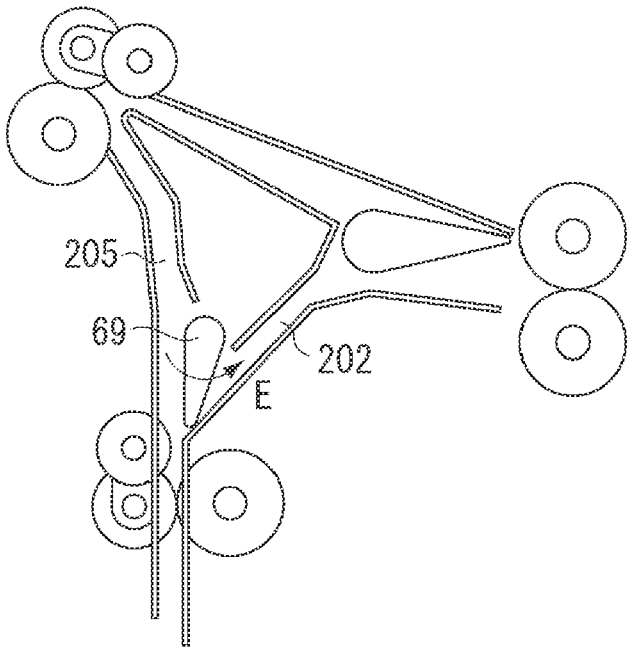
Figure 10F:
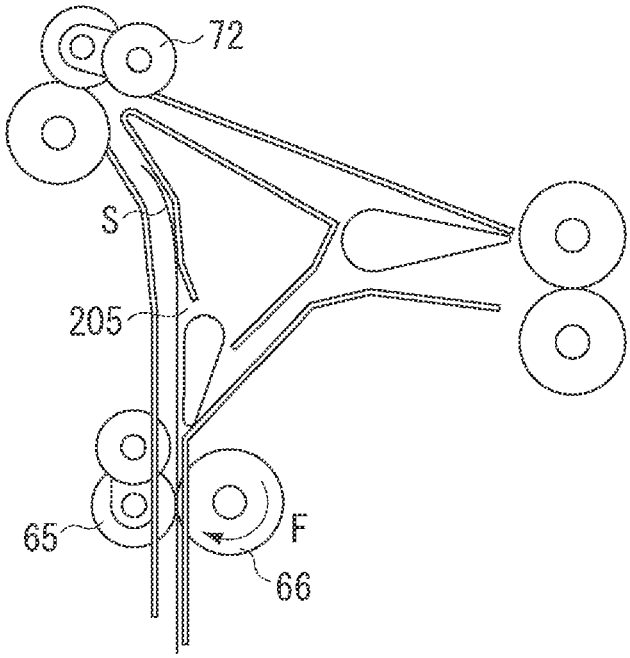

When the sheet S is switched back in the second reversing sheet conveyance path 205 and conveyed to the sheet discharge tray 7, the second flapper 69 is rotated in the direction of an arrow E and closes the first reversing conveyance path 202, as illustrated in FIG. 10E. Then, the reversing conveyance roller 66 is rotated in the direction of an arrow F, and the sheet S is conveyed to the sheet discharge tray 7 through the second reversing sheet conveyance path 205, as illustrated in FIG. 10F.

At this time, the leading edge of the sheet S abuts the sponge roller 72 and an impact by the abutting is absorbed by the elastic force of the sponge roller 72, so that the noise generated by the collision can be reduced.

When a sheet is further conveyed, the trailing edge of the sheet S passes through the second reversing sheet conveyance path 205. Then, the trailing edge of the sheet S is returned to an original state by the elastic force of the sheet S, and abuts the sponge roller 72. In this case also, the impact by the trailing edge of the sheet S is softened by elasticity of the sponge roller 72 and the generated noise can be reduced. The sheet S is conveyed to the sheet discharge tray 7.

In a third exemplary embodiment, a sheet conveyance apparatus according to the present invention is used for an image reading apparatus.

Figure 11:
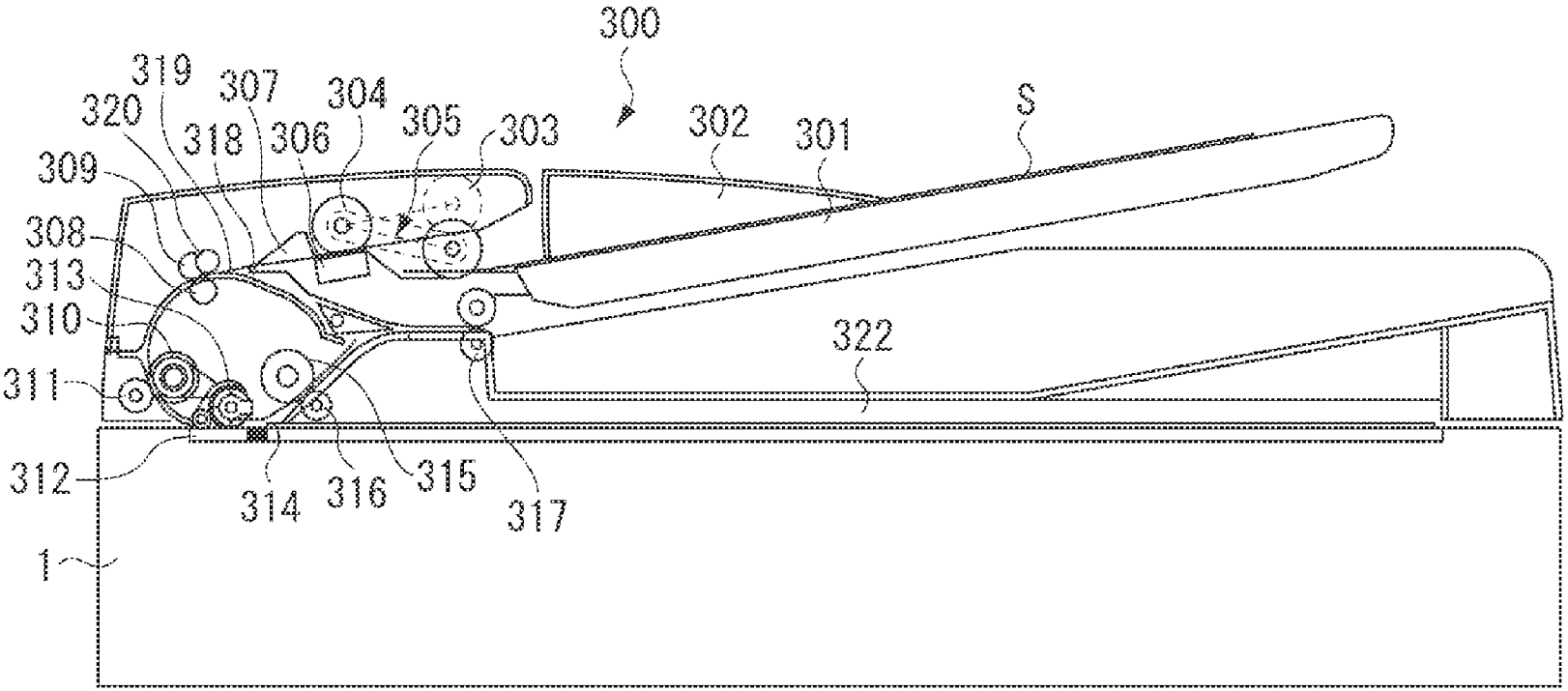
FIG. 11 is a cross-sectional view illustrating a state in which a sponge roller according to the exemplary embodiment is arranged at a joining portion of an image reading apparatus.

As illustrated in FIG. 11, an image reading apparatus according to the third exemplary embodiment includes a reader unit 1 as an image reading unit, and an automatic document conveyance apparatus 300 as a sheet conveyance apparatus for automatically conveying a document to the reader unit 1.

The automatic document conveyance apparatus 300 is arranged in the upper direction of the reader unit 1. Since the reader unit 1 has a similar configuration to the first exemplary embodiment (refer to FIG. 1), descriptions will be omitted.

In FIG. 11, a document tray 301 is for stacking sheets S, which is a document. In the document tray 301, a pair of width direction regulating plates 302 is slidably arranged in the width direction of the sheets S. The width direction regulating plate 302 regulates the width direction of the sheets S stacked on the document tray 301, and can secure conveyance stability when the document is conveyed.

A feeding roller 303 is provided in the upper direction of the document tray 301. The feeding roller 303 feeds a document (hereinafter referred to as the sheet S) acting together with a separation roller 304. The feeding roller 303 usually stands by at a position in the upper direction (a position drawn with a solid line in FIG. 11), which is a home position, so as not to interfere with a document setting operation.

When a feeding operation starts, the feeding roller 303 descends to a position drawn with a dashed line in FIG. 11, and abuts an upper surface of the sheet S. Since the feeding roller 303 is pivoted by an arm 305, the feeding roller 303 can be vertically moved by swinging the arm 305. A separation pad 306 is arranged in an opposing side of the separation roller 304, and applies pressure to the separation roller 304.

The separation pad 306 is made of a rubber material having slightly lower friction than the separation roller 304. The separation pad 306 processes every sheet S that is fed by the feeding roller 303, and feeds the sheet S by the separation roller 304.

A registration roller 308 and a registration driven roller 309 are positioned on the downstream of a first sheet conveyance path 307, and are a skew correction device for aligning leading edges of the sheets S fed by the separation roller 304. After the leading edge of the sheet S is abutted against a nip portion of the stopped registration roller 308 and the registration driven roller 309, the sheet S is further conveyed by the separation roller 304, so that a loop is formed and skew correction is carried out.

The sheet S is conveyed to a platen glass 312 by a a reading roller 310 and a reading driven roller 311. The sheet S conveyed to the platen glass 312 is picked up by a jump stand 314 through the platen roller 313, and is conveyed by a reading discharge roller 315 and a reading discharge driven roller 316.

After reading of an image of the sheet S is completed by a scanning optical system 12 that has moved to a lower part of the platen glass 312, the sheet S is discharged to a sheet discharge tray 322 by a discharge roller pair 317. In a two-sided reading mode, the sheet S is not discharged by the discharge roller pair 317, but switched back, guided by the second sheet conveyance path 318, and conveyed to the registration roller 308 and the registration driven roller 309. When the sheet S reaches the registration roller 308 and the registration driven roller 309, a back surface of the sheet S is read similarly to the above process.

In addition, in a joining portion 319 of the first sheet conveyance path 307 and the second sheet conveyance path 318, a sponge roller 320 is arranged. As for the sponge roller 320, the second sheet conveyance path 318 corresponds to the first sheet conveyance path of the present invention, and the first sheet conveyance path 307 corresponds to the second sheet conveyance path of the present invention.

Since the leading edge of the sheet S conveyed from the first sheet conveyance path 307 abuts the sponge roller 320, the impact by the abutting is absorbed by the elastic force of the sponge roller 320. With such a configuration, the noise generated by the collision of the leading edge of the sheet S to the registration driven roller 309 can be reduced.

Similarly, since the leading edge of the sheet S conveyed from the second sheet conveyance path 318 abuts the sponge roller 320, the impact by the abutting is absorbed by the elastic force of the sponge roller 320, and the noise generated by the collision can be reduced.

Further, the sponge roller 320 is arranged alternately with the registration driven roller 309 in the direction orthogonal to the sheet conveyance direction in the first sheet conveyance path 307. More specifically, in a projection surface of the direction orthogonal to the sheet conveyance direction in the first sheet conveyance path 307, an outer periphery of the sponge roller 320 and an outer periphery of the registration driven roller 309 are arranged partially overlapping each other in the first sheet conveyance path 307.

Effects of such a configuration are similar to the effects in the position relationship between the outer periphery of the sponge roller 37 and the outer periphery of the conveyance roller 35 according to the first exemplary embodiment. Thus, descriptions will be omitted.

As for other applying portions of the present invention, there are similar effects in a joining portion from the two-sided conveyance path 62 to the second sheet conveyance path 102 in FIG. 1. Further, there are similar effects in any joining portions of two sheet conveyance paths.

Figure 12:
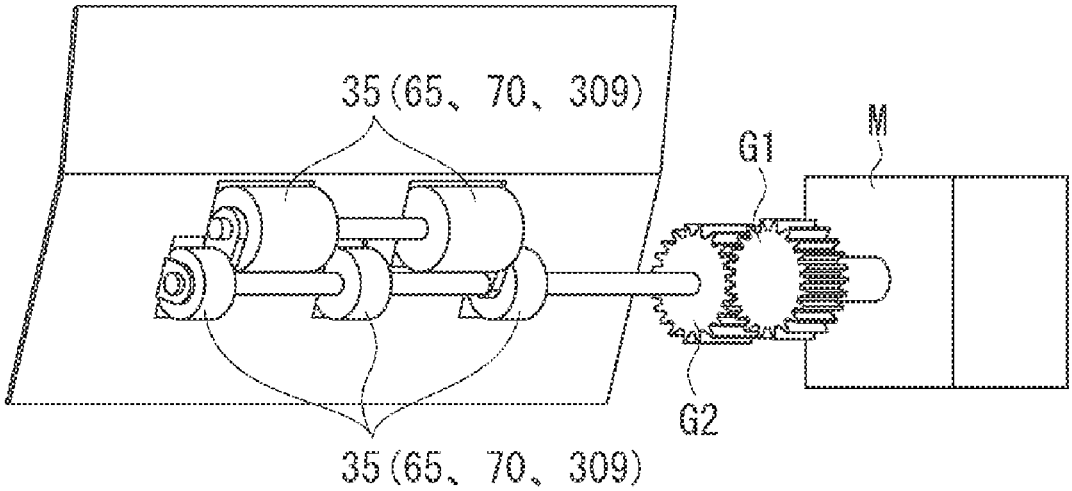
FIG. 12 is a perspective view illustrating a state in which a drive source is provided in a sponge roller.
Figure 13A:
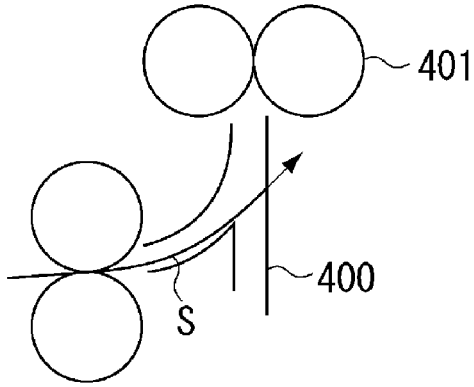
FIGS. 13A and 13B is a cross-sectional view illustrating a conventional example.
Figure 13B:
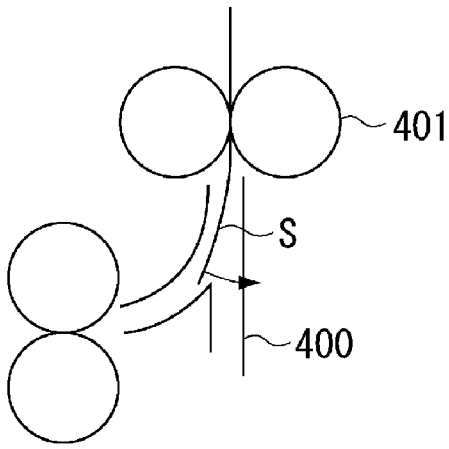
(PRIOR ART) FIG. 13B

In the exemplary embodiments 1 to 3, the sponge roller has a configuration which rotates by the collision of the leading edge of the sheet. However, as illustrated in FIG. 12, the sponge roller 37 (67, 72, 320) is configured to be rotatable via a driving source M and gears G1 and G2, rotated at the same conveyance speed as the sheet S, and may be included in the exemplary embodiments 1, 2, and 3. With this configuration, better conveyance performance can be obtained.

Further, when the sponge roller is rotated by the driving force, there are following advantages. For example, when the sponge roller is not rotated by the driving force, the leading edge of the sheet needs to abut the X area in FIG. 3. However, when the sponge roller is rotated by the driving force, the sheet can be conveyed even when the leading edge of a sheet abuts a peripheral surface on the lower side than the Y line in FIG. 3.

In the exemplary embodiments described above, the material of sponge for the sponge roller is polyether-based urethane. However, the durability of the sponge roller can be improved by coating a silicon-based material on the surface of the sponge roller.

Further, in the exemplary embodiments, the sponge roller is used as an elastic roller. However, the elastic roller is not limited to the sponge roller. The similar effects are obtained even when a rubber roller or silicon roller having low hardness is used. Furthermore, as for the elastic roller, if the elastic roller includes a sponge-like material or a rubber having low hardness on a surface thereof, similar effects can be obtained.

In addition, the number of the sponge rollers or width of the sponge roller can be properly changed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-272571 filed Nov. 30, 2009, which is hereby incorporated by reference herein in its entirety.

What is claimed is:

1. A sheet conveyance apparatus comprising:

a joining portion configured by joining a first sheet conveyance path to a second sheet conveyance path;

a first sheet conveyance unit provided on the upstream side of the joining portion and configured to convey a sheet in the first sheet conveyance path;

a second sheet conveyance unit provided on the downstream side of the joining portion and configured to convey a sheet conveyed from the first sheet conveyance path and a sheet conveyed in the second sheet conveyance path;

a rotatable elastic roller arranged along a conveyance guide surface forming the second sheet conveyance path and crossing an extension line of the first sheet conveyance path, and at a position in which a leading edge of a sheet conveyed from the first sheet conveyance path abuts, wherein a surface portion of the elastic roller includes an elastic material having lower hardness than hardness of a surface portion of the second sheet conveyance unit.

2. The sheet conveyance apparatus according to claim 1, wherein in a projection surface in the direction orthogonal to a conveyance direction of a sheet conveyed in the second sheet conveyance path, an outer periphery of the elastic roller and an outer periphery of the second sheet conveyance unit partially overlap in the second sheet conveyance path.

3. The sheet conveyance apparatus according to claim 1, wherein the first sheet conveyance unit includes a roller pair, and wherein in a projection surface in the direction orthogonal to a sheet conveyance direction of a sheet conveyed in the second sheet conveyance path, a rotation center of the elastic roller is positioned more on the upstream side in the conveyance direction than a line passing through a nip point of the roller pair and contacting a conveyance guide surface on the upstream side in the sheet conveyance direction, in conveyance guide surfaces forming the joining portion.

4. The sheet conveyance apparatus according to claim 1, wherein the elastic roller is rotated by a driving unit.

5. An image forming apparatus forming an image on a sheet conveyed by a sheet conveyance apparatus by an image forming unit, the image forming apparatus comprising:

a joining portion configured by joining a first sheet conveyance path to a second sheet conveyance path;

a first sheet conveyance unit provided on the upstream side of the joining portion, and configured to convey a sheet in the first sheet conveyance path;

a second sheet conveyance unit provided on the downstream side of the joining portion, and configured to convey a sheet conveyed from the first sheet conveyance path and a sheet conveyed in the second sheet conveyance path; and an elastic roller arranged, in conveyance guide surfaces forming the second sheet conveyance path, along a conveyance guide surface forming the second sheet conveyance path and crossing an extension line of the first sheet conveyance path, and at a position in which a leading edge of a sheet conveyed from the first sheet conveyance path abuts, wherein a surface portion of the elastic roller includes an elastic material having lower hardness than hardness of a surface portion of the second sheet conveyance unit.

6. The image forming apparatus according to claim 5, wherein in a projection surface in the direction orthogonal to a conveyance direction of a sheet conveyed in the second sheet conveyance path, an outer periphery of the elastic roller and an outer periphery of the second sheet conveyance unit partially overlap in the second sheet conveyance path.

7. The image forming apparatus according to claim 5, wherein the first sheet conveyance unit includes a roller pair, and wherein in a projection surface in the direction orthogonal to a sheet conveyance direction of a sheet conveyed in the second sheet conveyance path, a rotation center of the elastic roller is positioned more on the upstream side in the conveyance direction than a line passing through a nip point of the roller pair and contacting a conveyance guide surface on the upstream side in the sheet conveyance direction, in conveyance guide surfaces forming the joining portion.

8. The image forming apparatus according to claim 5, wherein the elastic roller is rotated by a driving unit.

9. An image reading apparatus reading a document conveyed from a sheet conveyance apparatus by an image reading unit, the image reading apparatus comprising:

a joining portion configured by joining a first sheet conveyance path to a second sheet conveyance path;

a first sheet conveyance unit provided on the upstream side of the joining portion, and configured to convey a sheet in the first sheet conveyance path;

a second sheet conveyance unit provided on the downstream side of the joining portion, and configured to convey a sheet conveyed from the first sheet conveyance path and a sheet conveyed in the second sheet conveyance path; and an elastic roller arranged along a conveyance guide surface forming the second sheet conveyance path and crossing an extension line of the first sheet conveyance path, and at a position in which a leading edge of a sheet conveyed from the first sheet conveyance path abuts, wherein a surface portion of the elastic roller includes an elastic material having lower hardness than hardness of a surface portion of the second sheet conveyance unit.

10. The image reading apparatus according to claim 9, wherein in a projection surface in the direction orthogonal to a conveyance direction of a sheet conveyed in the second sheet conveyance path, an outer periphery of the elastic roller and an outer periphery of the second sheet conveyance unit partially overlap in the second sheet conveyance path.

11. The image reading apparatus according to claim 9, wherein the first sheet conveyance unit includes a roller pair, and wherein in a projection surface in the direction orthogonal to a sheet conveyance direction of a sheet conveyed in the second sheet conveyance path, a rotation center of the elastic roller is positioned more on the upstream side in the conveyance direction than a line passing through a nip point of the roller pair and abutting a conveyance guide surface on the upstream side in the sheet conveyance direction, in conveyance guide surfaces forming the joining portion.

12. The image reading apparatus according to claim 9, wherein the elastic roller is rotated by a driving unit.

* * * * *